United States Patent [19]

Ethen et al.

[11] 4,388,359

[45] Jun. 14, 1983

[54] EMBOSSED PAVEMENT-MARKING SHEET MATERIAL

[75] Inventors: John L. Ethen, Oakdale; Timothy D. Bredahl, Stillwater, both of Minn.

[73] Assignee: Minnesota Mining and Manufacturing Company, Saint Paul, Minn.

[21] Appl. No.: 371,216

[22] Filed: Apr. 23, 1982

[51] Int. Cl.[3] ..... B32B 5/16; B32B 3/30

[52] U.S. Cl. ..... 428/143; 350/105; 404/12; 428/156; 428/325; 428/332; 428/913

[58] Field of Search ..... 428/143, 156, 325, 913, 428/168, 332; 404/8, 12, 9; 350/105

[56] References Cited

U.S. PATENT DOCUMENTS

| | | | |
|---|---|---|---|
| 1,518,988 | 12/1924 | Lehon . | |
| 3,190,178 | 6/1965 | McKenzie | 88/82 |
| 3,253,971 | 5/1966 | Garling | 156/246 |
| 3,587,415 | 6/1971 | Eigenmann | 94/1.5 |
| 3,879,148 | 4/1975 | Eigenmann | 404/10 |
| 3,935,365 | 1/1976 | Eignemann | 428/323 |
| 3,989,775 | 11/1976 | Jack et al. | 264/1 |
| 4,069,281 | 1/1978 | Eigenmann | 264/1 |
| 4,117,192 | 9/1978 | Jorgensen | 428/337 |
| 4,123,140 | 10/1978 | Ryan et al. | 350/105 |

FOREIGN PATENT DOCUMENTS 868524 4/1971 Canada .

OTHER PUBLICATIONS

Road Marking and Delineation–Feb. 1975, Ltr. from Heijmans Wegmarkeringen.

*Primary Examiner*—Paul J. Thibodeau

*Attorney, Agent, or Firm*—C. Alexander; D. M. Sell; R. R. Tamte

[57] ABSTRACT

Pavement-marking sheet material having protuberances on its upper surface which carry partially exposed microspheres by which the protuberances are made retroreflective and which are separated by recessed areas in which microspheres are fully embedded and not exposed, so as to improve the daytime appearance of the sheet material.

12 Claims, 1 Drawing Figure

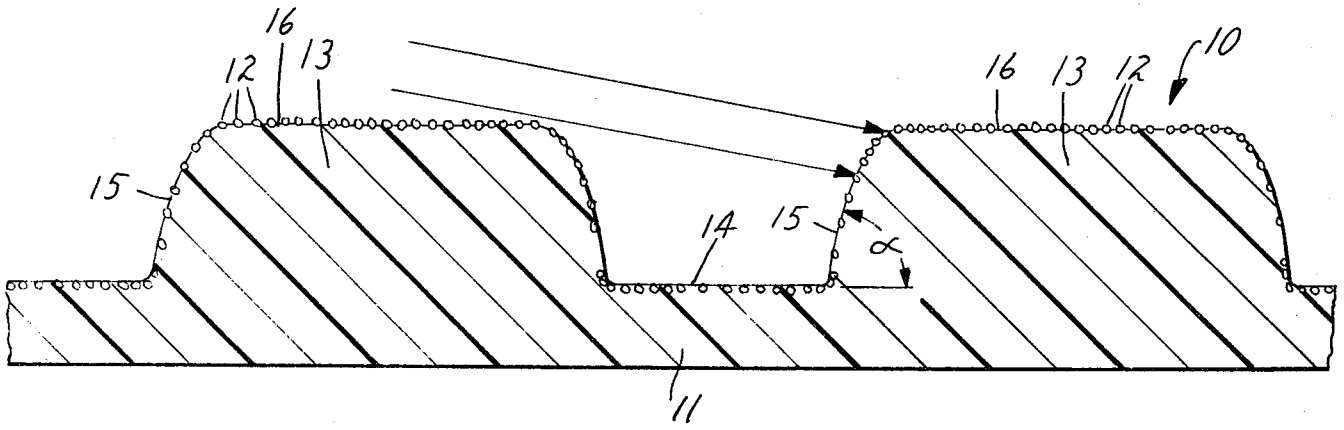
10
12
13
16
15
14
11
α
16
13
12
15

EMBOSSED PAVEMENT-MARKING SHEET MATERIAL

BACKGROUND OF THE INVENTION

The prior art has on several occasions suggested preparing pavement-marking tapes with reflective protuberances on their upper surface to improve the visibility of the markings, especially at night and when the roadway is wet. One example is U.S. Pat. No. 4,069,281, which teaches a polymeric sheet material formed with protuberances on its upper surface and with reflective glass beads and/or abrasive particles concentrated on the protuberances. As taught in column 5, lines 16 and 17, the concentration of glass beads or abrasive particles is achieved by cascading those particles more densely over the protuberances than over other parts of the sheet material during manufacture of the sheet material, whereupon the particles apparently become partially embedded in the sheet material. The concentration of particulate matter is desired so that other areas of the pavement marking are left more smooth, whereupon they resist the collection of dirt that would occur around projecting particles and that would discolor the marking.

Another pavement-marking tape, understood to be commercially marketed, comprises a mixture of a polymer like polyvinyl chloride and glass beads formed into a sheet having many protuberances on its upper surface. The glass beads are fully embedded in the finished sheet material and become exposed by wear. Since the side surfaces of the protuberances experience little wear, so that few beads become exposed there, and since the side surfaces of the protuberances are most directly in line with the light rays from the headlights of vehicles traveling on the roadway, reflection from the marking is low.

A different commercial pavement marking comprises a stripe of thermoplastic material applied on the roadway and then embossed to have protuberances on its upper face. Glass beads are mixed into the thermoplastic material before it is applied, and additional glass beads are applied to the stripe as it is laid. The additional glass beads apparently fall onto the stripe indiscriminately, both on the protuberances and between them, leading to the problem of dirt collection noted above.

Another related type of prior art product taught in Canadian Pat. No. 868,524 comprises reflective elements having flat upper and lower surfaces and vertical side walls in which glass beads are partially embedded. Such elements are made by extruding a rod of plastic, embedding glass beads in the sides of the rods, and slicing the rod into thin flat elements. The elements are cascaded onto painted lines, where the top flat surface, which has no glass beads, provides improved daylight appearance, and the glass-bead-covered vertical sides provide retroreflectivity.

All of the above products have important deficiencies: some of them are cumbersome to make and use, some do not provide reliable, bright, long-term reflectivity, and some do not achieve an optimum combination of good daytime appearance and bright nighttime reflectivity.

SUMMARY OF THE INVENTION

The present invention provides a new pavement-marking sheet material which can be made by a new efficient and effective procedure, and which exhibits a good combination of reflectivity, desired daytime color and minimized dirt collection. Briefly, this new pavement marking sheet material is prepared by the steps of (1) preparing a deformable polymeric base sheet; (2) depositing a monolayer of transparent microspheres on the base sheet; and (3) embossing the microsphere-covered base sheet so as to (a) deform the base sheet and form protuberant areas separated by depressed areas, and (b) partially embed the glass microspheres into the base sheet in the protuberant areas and fully embed the microspheres into the base sheet in the depressed areas.

The novel pavement-marking sheet material prepared by the described method comprises, in brief summary, a continuous polymeric sheet having its upper surface configured with a multitude of protuberances which in total occupy at least 10 percent of the area of said upper surface. A side surface of the protuberances, which forms an angle to the plane of the base sheet of between about 30° and 90°, is adapted to face oncoming traffic when the sheet material is applied to a roadway. Transparent microspheres are partially embedded in the side surface at least near the top of the protuberance, and partially protrude out of the surface. At least one dimension of the protuberances in the plane of the film is less than about 15 millimeters. The sheet material is substantially free of protruding microspheres in the depressed areas between protuberances, but microspheres are fully embedded within the sheet material in those areas.

DESCRIPTION OF THE DRAWING

The FIGURE shows a cross-section through an illustrative pavement-marking sheet material of the invention.

DETAILED DESCRIPTION

The illustrative pavement-marking sheet material of the invention 10 shown in FIG. 1 comprises a deformable polymeric base sheet 11 and a layer of transparent microspheres 12 applied over the surface of the base sheet 11. The base sheet is configured with protuberances 13 separated by depressed areas 14. On the side surfaces 15 and top surfaces 16 of the protuberances 13, the microspheres 12 are partially embedded in the surface of the sheet and partially exposed outside the sheet and thereby can perform a reflective function. In the depressed areas 14 between the protuberances the microspheres 13 are fully embedded into the base sheet.

The polymeric base sheet should be deformable to permit embossing, generally under heat and pressure. It also is desirably viscoelastic after completion of the sheet material to permit absorption of the forces and pressures of wheeled road traffic when applied on a roadway without creating internal forces that tend to remove the marking from the roadway. Such deformation properties can be obtained with base sheets described in U.S. Pat. No. 4,117,192, which is incorporated herein by reference. The base sheets described in the patent comprise elastomer precursors, i.e., ingredients that when vulcanized, cured or cross-linked form an elastomer (a material that may be stretched 100% or more of its original dimensions without rupture and upon release of the stretching force rapidly returns to substantially its original dimensions), but which are not vulcanized or cured to an elastomeric character in the sheet material of the invention and therefore permit viscoelastic deformation. Particularly useful materials are acrylonitrile-butadiene polymers, millable urethane polymers, and neoprenes, which preferably account for at least 50 weight-percent of the polymeric ingredients in the base sheet. Extender resins such as chlorinated paraffins, hydrocarbon resins, or polystyrenes may also be included.

The microspheres 12 embedded in the base sheet 11 are generally glass microspheres having an index of refraction between about 1.5 and 2.0. The microspheres generally average between about 100 and 1500 micrometers in diameter, and preferably are less than about 1000 micrometers in average diameter. The microspheres should be embedded to between about 20 and 80, preferably between 40 and 70 percent, of their diameter on the side surfaces 15 of the protuberances so as to be retained well in the sheet and yet provide desired reflection. The depth of embedding can be controlled by controlling the pressure applied to the intermediate microsphere-covered base sheet. Control of the embossing pressure also assures that the microspheres are fully embedded in the recessed areas between protuberances and become partially embedded in the protuberances. The microspheres tend to be spaced further apart near the base of the protuberances, since those portions are deformed a greater distance, and also the microspheres tend to be embedded in those areas because greater pressure is applied in those areas. Adhesion of the microspheres to the base sheet can be assisted by use of an adhesion-promoting agent such as silanes coated on the microspheres or dispersed in the base sheet.

Some of the microspheres 12 may be replaced with abrasive particles, such as sand or aluminum oxide, which roughen the surface of the sheet material and thereby limit slipping of vehicle wheels on a pavement marking made from the sheet material. Skid-resistance is further assisted by the embossed nature of the sheet material.

Particulate materials are also included in the polymeric base sheet, typically in large amount, to lower cost and provide modified properties. A large proportion of these particulate materials are fine-diameter fillers, such as silica, asbestos, etc. Microspheres and skid-resisting particles are also desirably included in the sheet, and as the sheet is worn away the embedded microspheres and skid-resisting particles may replenish particles lost through attrition of the sheet. Pigments such as titanium dioxide and other additives may also be included in the base sheet.

Generally the base sheet 11 is at least about 1 millimeter thick but less than about 5 millimeters thick, and preferably less than 3 millimeters thick.

The partially exposed microspheres give the sheet material a gray cast, and the microsphere-covered areas of the sheet material are minimized to maintain the desired white or other color of the sheet material. Generally the area of the sheet material carrying partially exposed microspheres should occupy no more than 85 percent, preferably no more than 50 percent, of the total area of the sheet material. Correspondingly, the depressed areas 14 of the sheet material should occupy at least 15 percent, and preferably at least 50 percent of the area of the sheet material.

The protuberances generally are at least about one millimeter in height and are spaced at least about one and preferably at least two millimeters in the direction of expected vehicular traffic. The result is that a good proportion of light impinging on the sheeting at a high incidence angle (the angle between the light and a line perpendicular to the sheet material), i.e., of about 87° to 89.5°, will strike the microsphere-covered top portions of the protuberances and be retroreflected back toward the source of the light. The protuberances should be narrow (i.e., have a short length in the plane of the base sheet) in the direction of expected road travel, so as to maximize the number of protuberances and therefore the reflectivity of the sheet material, and to minimize the microsphere-covered top surfaces of the base sheet which detract from daytime color. Generally at least one dimension of the protuberances in the plane of the base sheet should be less than about 15 millimeters, and preferably less than 10 millimeters, and preferably all dimensions of the protuberances in the plane of the sheet are less than these values.

The maximum retroreflection of high-incidence-angle light is achieved when the side surfaces 15 of the protuberances are perpendicular to that light. For that reason the side surfaces 15 should form an angle to the plane of the base sheet (the angle alpha in the drawing) of at least about 30° and preferably at least 60°, and more preferably even higher. The side surfaces need not be perpendicular to the direction of expected travel, and in fact, an arrangement in which the recessed areas 14 form a continuous grid of troughs or valleys extending diagonally with respect to the direction of expected travel is preferred for allowing water runoff, ease of manufacture, and exposure of the side surfaces of the protuberances (i.e., a side surface faces oncoming traffic through a trough running diagonally in front of the side surface).

What is claimed is:

1. Pavement-marking sheet material comprising a continuous polymeric base sheet having its upper surface configured with a multitude of protuberances which in total occupy at least 10 percent of the area of the base sheet, said protuberances having at least one dimension in the plane of the base sheet that is less than about 15 millimeters, having a height of at least about one millimeter, and having a side surface that is adapted to face oncoming traffic when the sheet material is applied to a roadway and which forms an angle to the plane of the base sheet of at least about 30°, said side surface carrying transparent microspheres at least near the top of the protuberance, which are partially embedded in the surface and partially protrude out of the surface, and the areas of the base sheet between the protuberances being substantially free of protruding microspheres but containing microspheres which have been substantially fully pressed into the base sheet.

2. Sheet material of claim 1 in which all dimensions of the protuberances in the plane of the base sheet are less than about 15 millimeters.

3. Sheet material of claims 1 or 2 in which the protuberances have at least one dimension in the plane of the base sheet that is less than about 10 millimeters.

4. Sheet material of claim 1 in which the protuberances occupy no more than about 50 percent of the area of the base sheet.

5. Sheet material of claim 1 in which said side surface of the protuberances forms an angle of at least about 60° to the plane of the base sheet.

6. Sheet material of claim 1 in which the concentration of microspheres on the side surfaces of the protuberances is less near the base of the side surfaces than near the top.

7. Sheet material of claim 1 in which the areas between protuberances form a connected grid of valleys.

8. Sheet material of claim 1 in which the base sheet comprises an unvulcanized elastomer precursor.

9. Pavement-marking sheet material comprising a continuous viscoelastic polymeric base sheet that comprises an unvulcanized elastomer precursor and which has its upper surface configured with a multitude of protuberances which in total occupy between about 10 and 50 percent of the area of the base sheet, said protuberances having at least one dimension in the plane of the base sheet that is less than about 15 millimeters, having a height of at least about one millimeter, and having a side surface that is adapted to face oncoming traffic when the sheet material is applied to a roadway and which forms an angle to the plane of the base sheet of at least about 60°, said side surface carrying transparent microspheres at least near the top of the protuberance, which are partially embedded in the surface and partially protrude out of the surface, and the areas of the base sheet between the protuberances being substantially free of protruding microspheres but containing microspheres which have been substantially fully pressed into the base sheet.

10. Sheet material of claim 9 in which all dimensions of the protuberances in the plane of the base sheet are less than about 15 millimeters.

11. Sheet material of claim 9 in which all dimensions of the protuberances in the plane of the base sheet are less than about 10 millimeters.

12. Sheet material of claim 9 in which the areas between protuberances form a connected grid of valleys running diagonally with respect to the direction of expected road travel.

* * * * *